US005246336A

United States Patent [19]

Furukawa

[11] Patent Number: 5,246,336

[45] Date of Patent: Sep. 21, 1993

[54] MOTOR DRIVEN COMPLEX PUMP APPARATUS

[75] Inventor: Chisiro Furukawa, Kawasaki, Japan

[73] Assignee: Fuji Electric Co., Ltd., Kawasaki, Japan

[21] Appl. No.: 868,563

[22] Filed: Apr. 15, 1992

[30] Foreign Application Priority Data

Jun. 21, 1991 [JP] Japan ..... 3-149034
Jan. 30, 1992 [JP] Japan ..... 4-14383
Feb. 28, 1992 [JP] Japan ..... 4-41788

[51] Int. Cl.[5] ..... F04D 1/06

[52] U.S. Cl. ..... 415/98; 415/100; 415/102; 415/103; 415/198.1; 417/423.14; 417/424.1

[58] Field of Search ..... 415/98, 99, 100, 101, 415/102, 103, 198.1; 417/360, 363, 423.14, 424.1

[56] References Cited

U.S. PATENT DOCUMENTS 2,315,656 4/1943 Rhoda ..... 415/101
2,407,987 8/1946 Landberg ..... 415/100
2,625,110 1/1953 Haentjens et al. ..... 417/423.12
2,694,365 11/1954 Armstrong .
2,701,530 2/1955 Schellerer ..... 415/99
2,727,468 12/1955 Rykken ..... 415/98
2,808,782 10/1957 Thompson et al. ..... 415/98
3,229,642 1/1966 Lobanoff et al. ..... 415/100

FOREIGN PATENT DOCUMENTS 2249510 4/1973 Fed. Rep. of Germany ..... 415/98
2156964 6/1973 France .
18007 2/1978 Japan ..... 415/99
62-189399 8/1987 Japan .
63-32195 2/1988 Japan .
1-97032 6/1989 Japan .
3-92596 4/1991 Japan .
479674 2/1938 United Kingdom ..... 415/99
1598914 9/1981 United Kingdom ..... 415/101

OTHER PUBLICATIONS

Patent Abstracts of Japan, (M-78) & JP-A-53 116502 (Hitachi Seisakusho) Dec. 10, 1978, abstract.
"Coolant Pumps", The Japan Electric Machinery Association, JEM 1242 (1970), Dec. 9, 1970.

*Primary Examiner*—Edward K. Look
*Assistant Examiner*—Michael S. Lee
*Attorney, Agent, or Firm*—Spencer, Frank & Schneider

[57] ABSTRACT

An electric motor includes a pump leg on the driving side thereof, and a bracket, a flange, discharge joints, extension tubes and a volute chamber cover are integrated into the pump leg 6. The extension tubes are arranged opposite to each other at the positions spaced away from each other by an angle of about 180 degrees in the circumferential direction. A volute chamber of a first pump and a volute chamber of a second pump are formed integral with a distance suction casing fixedly secured to the lower surface of the pump leg while a suction port for the first pump is located opposite to a suction port of the second pump. In addition, a volute chamber cover is fixedly secured to the lower surface of the distance suction casing. The volute chamber is communicated directly with the extension tube, while the volute chamber is communicated with the extension tube via an intermediate discharge port which is formed integral with the distance suction casing while extending in the axial direction in the region located sideward of the volute chamber.

12 Claims, 8 Drawing Sheets

MOTOR DRIVEN COMPLEX PUMP APPARATUS

BACKGROUND OF THE INVENTION

1. Field of the Invention

The present invention relates generally to an immersion type motor driven complex pump apparatus including two independent pumps which may be driven by a single motor, wherein the motor is arranged above the surface level of a liquid to be pumped, while the pumps are immersed in a bath containing the liquid. More particularly, the present invention relates to a motor driven complex pump apparatus preferably employable as a coolant pump for pumping a cooling solution for a machine tool, wherein the complex pump apparatus comprises a centrifugal pump and a half-shrouded pump including a volute chamber.

2. Description of the Prior Art

For example, a single stage type centrifugal pump as prescribed by the Japan Electric Machinery Association in standard rule JEM 1242 (1970) entitled "Coolant Pump" is known as a pump employable in the field of machine tools. In addition, a multistage pump as disclosed in an official gazette of Japanese Patent Application Laid-open (Kokai) No. 62-189399 is known as a multistage immersion type pump. Further, complex pumps as disclosed in Japanese Patent Application Laid-open No. 63-32195 and Japanese Utility Model Application Laid-open No. 1-97032 are known as general complex pumps. Usually, as a coolant pump for machine tools, two or more motor driven complex pumps are used for each machine tool in such a manner that a pressure type motor driven pump is employed for the purpose of lubricating and cooling a cutting/grinding surface of a workpiece and blowing chips or ground particles generated by the cutting/grinding operation, while a flow rate type motor driven pump is employed for the purpose of washing chips or ground particles away from a bed of a machine tool.

According to the prior art described above, there is a necessity for reserving the space required for installing two or more motor driven pumps for each machine tool. To satisfactorily meet the foregoing necessity, a problem arises in that two or more wiring systems should be arranged for driving electric motors for the pumps. In the case where the pressure type motor driven pump and the flow rate type motor driven pump are operated under the same conditions a similar problem arises when two sets of the same motor driven pumps are used. Under some circumstances, two discharge tube systems are arranged corresponding to a single pump having double the flow rate since the pump has the same combined pump properties of the aforementioned pumps. In this case, when one of the two discharge tube systems is fully closed or partially closed, the flow rate of a liquid flowing through the other discharge tube systems varies. To avoid the foregoing malfunction, two sets of identical motor driven pumps should be used.

SUMMARY OF THE INVENTION

The present invention has been made with the foregoing background in mind.

An object of the present invention is to provide a motor driven complex pump apparatus preferably employable as a coolant pump wherein a single electric motor is operatively connected directly to two independent pumps while the motor is arranged above the surface level of a liquid to be pumped and the pumps are immersed in a bath containing the liquid.

Another object of the present invention is to provide a motor driven complex pump apparatus of the aforementioned type wherein the apparatus constructed is small in dimension, and moreover, can be easily handled.

According to the present invention, there is a motor driven complex pump apparatus comprising:

an electric motor for driving a vertically extending driving shaft;

a pump leg member of which upper side supports the motor while the driving shaft extends therethrough and of which lower side defines one part of a volute chamber of a first pump;

first casing means arranged below the pump leg member, for defining other part of the volute chamber of the first pump;

second casing means arranged below the first casing means, for defining a volute chamber of a second pump;

a first impeller fixedly mounted on the driving shaft, the first impeller being received in the first casing means; and a second impeller fixedly mounted on the driving shaft, the second impeller being received in the second casing means.

Here, the pump leg member integrally may comprise:

a flange for mounting the apparatus;

a first extension tube portion communicated with the first pump;

a second extension tube portion communicated with the second pump;

a first discharge joint communicated with the first extension tube portion; and a second discharge joint communicated with the second extension tube portion.

The first extension tube portion and the second extension tube portion may be arranged opposite to each other at the positions spaced away from each other by an angle of about 180 degrees.

The first casing means and an upper side of the second casing means may be constituted by a distance suction casing, the distance suction casing comprising a first horizontal wall having a suction port for the first pump formed therein, a second horizontal wall having a suction port for the second pump formed therein, the second horizontal wall extending substantially in parallel with and being apart from the first horizontal wall at a predetermined distance, and an intermediate discharge port communicated with a discharge port of the second pump, the intermediate discharge port extending in the vertical direction in the region located at the side of the first horizontal wall and the second horizontal wall.

The second impeller may be dimensioned to have a diameter larger than that of the first impeller.

The first casing means and an upper side of the second casing means may be constituted by a distance suction casing, the distance suction casing comprising a first horizontal wall having a suction port for the first pump formed therein, a second horizontal wall having a suction port for the second pump formed therein, the second horizontal wall extending substantially in parallel with and being apart from the first horizontal wall at a predetermined distance, and an intermediate discharge port communicated with a discharge port of the second pump, the intermediate discharge port extending in the vertical direction in the region located sideward of the first horizontal wall and the second horizontal wall.

A common casing may be constructed of the first casing means and an upper side of the second casing means, the common casing comprising a horizontal partition disposed between the first pump and the second pump and an intermediate discharge port communicated with a discharge port of the second pump, the intermediate discharge port extending in the vertical direction in the region located at the side of the horizontal partition.

A suction port of the first pump may be formed around a through hole opened on the pump leg member so as to allow the driving shaft to extend through the through hole, and a suction port of a second pump may be formed at the central part of a cover member placed on the lower end of the common casing.

A plurality of pump casings may be additionally arranged below the common casing, and the second pump may be a multistage pump.

The first casing means may include a plurality of pump casings, and the first pump may be a multistage pump.

A discharge port of the second casing means may be communicated with the discharge joint formed on the pump leg member via an extension tube, and a discharge port of the first casing may be communicated with an extension tube portion which leads to the discharge joint formed on the pump leg member.

The first casing means and the second casing means may be fixedly secured to the pump leg member by tightening a plurality of bolts.

The apparatus may further comprise support columns between the first horizontal wall and the second horizontal wall.

The first casing means may comprise a first intermediate discharge port extending in the vertical direction in the region located at the side of the volute chamber of the first pump; and the second casing means may comprise:

a first casing member defining an upper side of a volute chamber of the second pump and having a suction port formed at the central part thereof, the first casing member having a second intermediate discharge port formed at the side part thereof which communicates with the first intermediate discharge port, and a second casing member secured to the first casting member and having a discharge port formed therein, the discharge port being communicated with the second intermediate discharge port.

The second impeller may be dimensioned to have a diameter larger than that of the first impeller.

According to the present invention, since two pumps are arranged corresponding to a single electric motor, the pump apparatus has advantages that a wiring system for the motor can be simplified, the operative state of each pump can be determined independently and the projected dimensions of the pump apparatus as measured in the axial direction can be reduced substantially. In practical use, the pump apparatus is immovably mounted on a tank containing a liquid to be pumped, with the aid of a flange employable for a mounting operation, while the motor is arranged above the surface level of the liquid and the two pumps are immersed in a bath of the liquid without the need for a suction piping system. Since piping connected to joints on the discharge side of the pump apparatus at the positions located immediately above the flange are required to extend over the tank without interference, not only a mounting operation but also a piping operation can be easily performed with excellent quality results.

The two extension tubes are arranged around the driving shaft at opposing positions circumferentially spaced by an angle of about 180 degrees. With such arrangement, the radial load exerted on an impeller of one pump as a liquid flows along spirally extending passages in a volute or volute chamber is canceled by the radial load exerted on an impeller of the other pump in the same manner as mentioned above, resulting in a reduction of the radial load upon the bearings. In addition, there is no possibility that either impeller may inadvertently make contact with its casing due to bending deformation of the long driving shaft.

When the joints on the discharge side of the pump apparatus, the flange, the volute chamber cover and the two extension tubes which are arranged around the driving shaft and integrated into the pump leg member, the pump apparatus is highly rigid, enabling it to be constructed by the small number of components. In addition, since high rigidity is established among the two pumps and the motor, each impeller can be rotated with high dimensional accuracy relative to the corresponding volute chamber. Due to the fact that the two extension tubes are arranged opposite to each other around the driving shaft at positions spaced away from each other by an angle of about 180 degrees in the circumferential direction, the rigidity of the pump leg member can be further improved. In addition, essential components required for constituting the pump apparatus can easily be fabricated by employing a casting process.

When two volute chambers are integrally formed with a single distance suction casing, the number of components required for constituting the pump apparatus can likewise be reduced. In this case, since two impellers are arranged in a spaced relationship with the distance suction casing interposed therebetween while their suction ports are formed opposite to each other, the thrust load induced by one impeller is canceled by the thrust load induced by other impeller, resulting in a decreased thrust load borne by the bearing. An intermediate discharge port can easily be formed integrally with a lower casing for the lower pump without the necessity for a special piping operation. A significant feature of the pump apparatus consists in that outer diameters of the respective components can be reduced substantially. Since the distance suction casing can be fabricated merely by machining two parallel surfaces thereof, and moreover, can be simply assembled with the pump leg and the volute chamber cover, a distance between the upper surface of each impeller and the lower surface of the opponent member as seen in the axial direction can be easily maintained with high dimensional accuracy. Thus, performance of the pump apparatus can be improved with minimum liquid leakage while each axial gap is kept at a minimum. Since the driving shaft does not extend through the volute chamber cover for the lower pump, liquid leakage does not arise with the pump apparatus.

When a pump including an impeller having a larger diameter is arranged in the lower region of the pump apparatus so that an intermediate discharge port extends in the vertical direction in the region located at the side of a volute chamber for a pump including an impeller having a smaller diameter, the region, including the intermediate discharge port where the diametrical dimension tends to be large, can be designed to have a reduced outer diameter. Thus, the whole structure of the pump apparatus can be determined to have reduced diametrical dimensions without any enlargement of the flange. Due to the fact that the driving shaft does not extend through the volute chamber cover for the lower pump and thereby limiting any liquid leakage, a remarkably advantageous effect is obtainable when an impeller for each pump is dimensioned to have a larger diameter so as to pump a liquid under a higher pressure.

In the case where two volute chambers are formed together with an intermediate discharge port in a single casing with a partition interposed therebetween, the number of components required for constituting the pump apparatus can likewise be reduced while their diametrical dimensions are kept small. It should be added that these components can easily be fabricated employing a casting process. In this case, since suction ports are formed with an axially opposed attitude and respective impellers are arranged in the back-to-back relationship, the thrust load generated by a certain impeller is canceled by the thrust load generated by each of the other impellers, resulting in a thrust load to be borne by the bearing being likewise reduced. Leakage of the liquid through annular gaps on partitions for a multistage pump having the driving shaft extending therethrough is suppressed by the pressure of a liquid discharge from a single stage pump, while the remaining liquid is recovered on the discharge side of the single stage pump. Consequently, leakage loss does not arise with the pump apparatus of the present invention.

The above and other objects, effects, features and advantages of the present invention will become more apparent from the following description of embodiments thereof taken in conjunction with the accompanying drawings.

BRIEF DESCRIPTION OF THE DRAWINGS

The present invention is illustrated in the following drawings in which.

DETAILED DESCRIPTION OF PREFERRED EMBODIMENTS

Figure 1:
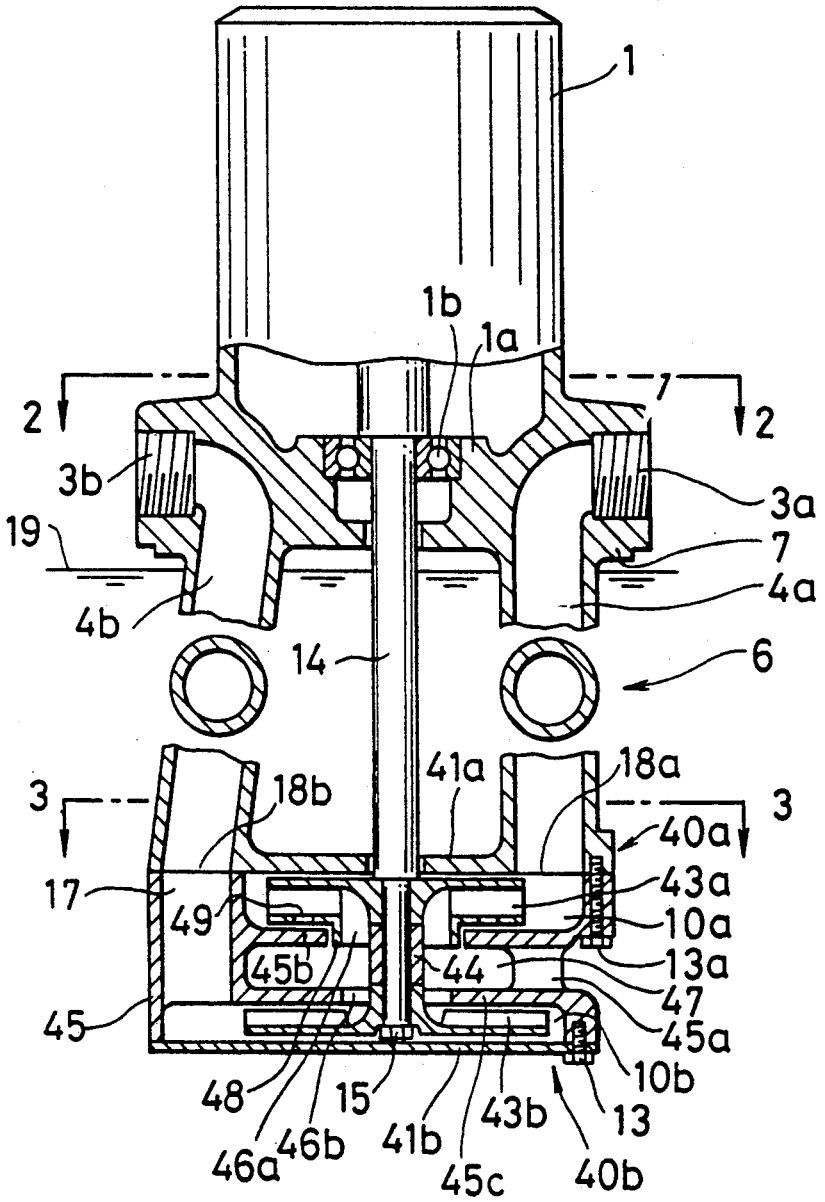
FIG. 1 is a vertical sectional view of a motor driven complex pump apparatus in accordance with a first embodiment of the present invention.
Figure 2:
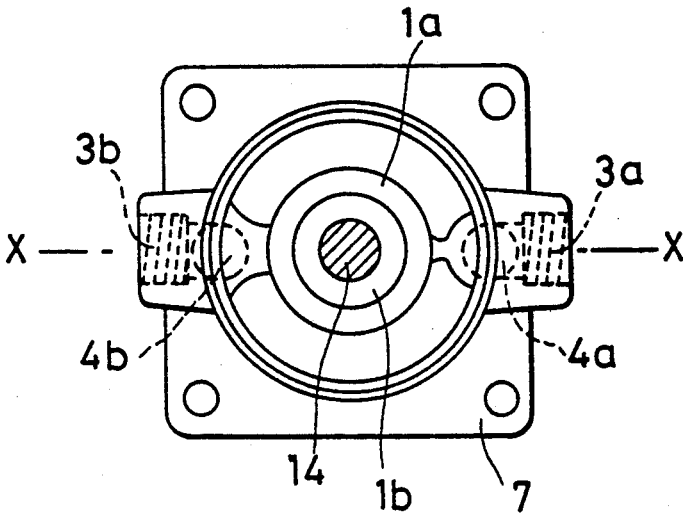
FIG. 2 is a cross-sectional view of the complex pump taken along line 2—2 in FIG. 1.
Figure 3:
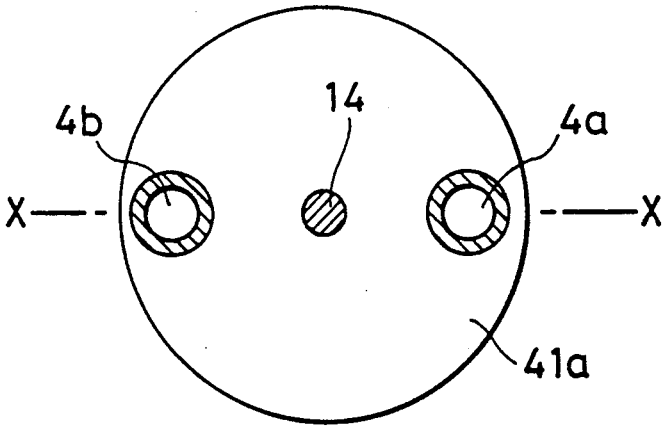
FIG. 3 is a cross-sectional view of the complex pump taken along line 3—3 in FIG. 1.
Figure 4:
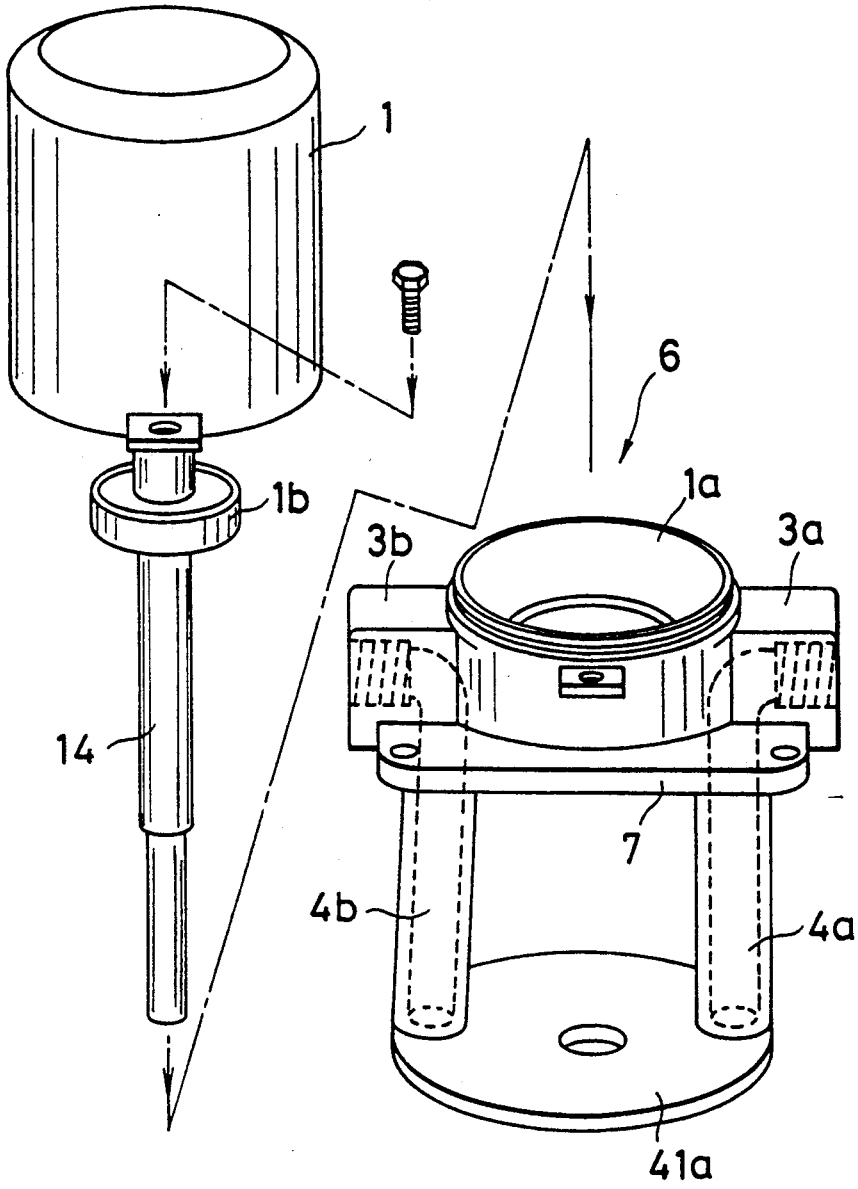
FIG. 4 is a schematic perspective view of the complex pump shown in FIG. 1, particularly illustrating the structure of the complex pump in the disassembled state.
Figure 5:
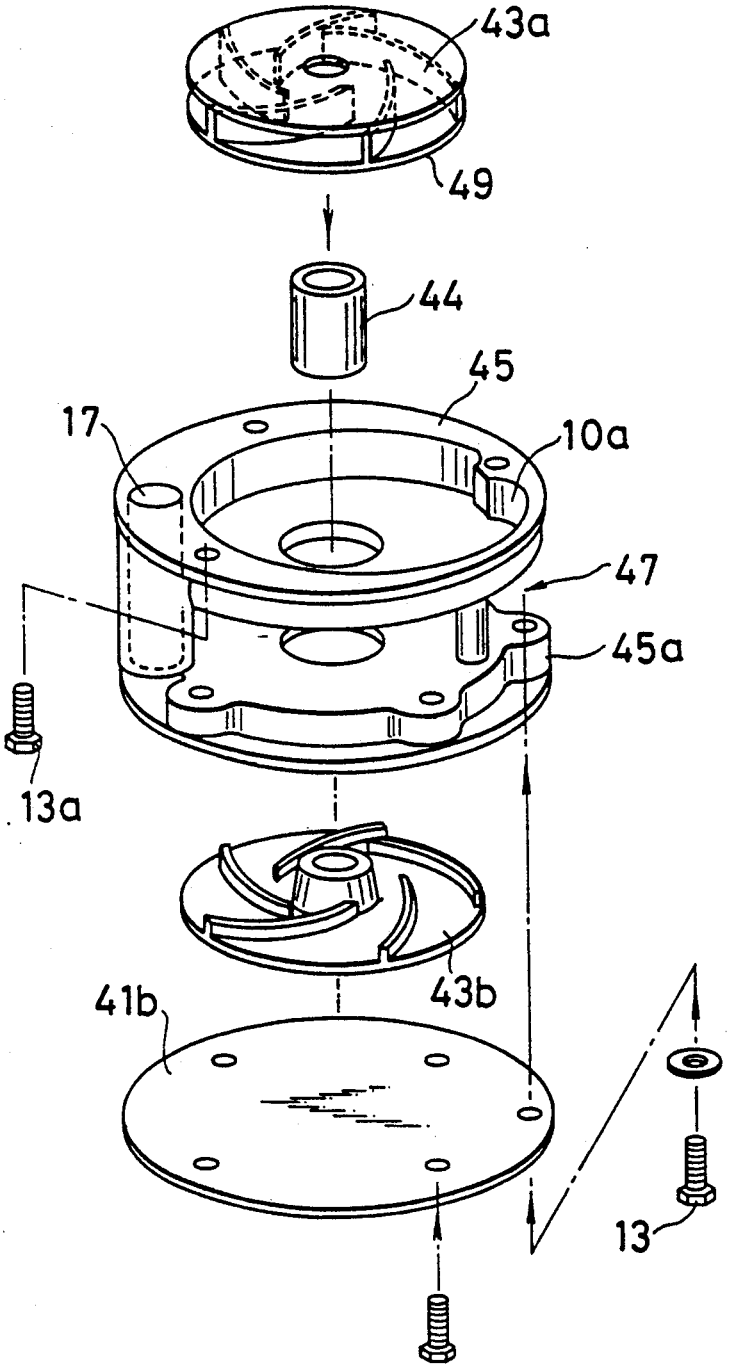
FIG. 5 is a perspective view of the complex pump shown in FIG. 1, particularly illustrating the lower part of the complex pump in the disassembled state.

Now, the present invention will be described in detail hereinafter with reference to the accompanying drawings which illustrate preferred embodiments of the present invention.

Referring to FIG. 1 to FIG. 5 which illustrate a motor driven complex pump apparatus or assembly in accordance with a first embodiment of the present invention, the complex pump apparatus has a pump leg 6 on the lower driving side of a vertical shaft type motor 1, and joints 3*a* and 3*b* on the discharge side of the pump. Extension tubes 4*a* and 4*b* and a volute chamber cover 41*a* for a first pump 40*a* located on the motor side are integrated with the pump leg 6. The two joints 3*a* and 3*b* and the two extension tubes 4*a* and 4*b* of the pump leg 6 are arranged at the positions located opposite to and parted away from each other by an angle of 180 degrees as seen in the circumferential direction. In addition, a flange 7 for mounting the complex pump apparatus on a tank containing a liquid to be pumped and a bracket 1*a* on the driving side of the motor 1 are integrated with the pump leg 6.

A distance suction casing 45 is fixedly secured to the lower surface of the volute chamber cover 41*a* of the pump leg 6 by tightening a plurality of bolts 13*a*. While the distance suction casing 45 is reinforced with support columns 45*a*, an impeller 43*a* for the first pump 40*a* is received in a first volute chamber 10*a* and an impeller 43*b* for a second pump 40*b* is received in a second volute chamber 10*b*. Both the volute chambers 10*a* and 10*b* are arranged such that their suction ports 46*a* and 46*b* are located opposite to each other with a common suction space 47 interposed therebetween The suction space 47 is defined by first and second horizontal walls 45*b* and 45*c* with a predetermined distance kept therebetween. It should be noted that both the suction ports 46*a* and 46*b* are opened in the region below the surface level 19 of a liquid to be pumped.

Additionally, a volute chamber cover 41*b* for the second pump 40*b* is fixedly secured to the lower surface of the suction casing 45 by tightening a plurality of bolts 13. The first impeller 43*a* and the second impeller 43*b* are fixedly mounted on a driving shaft 14 of the motor 1 by tightening a bolt 15 while a spacer 44 is interposed between the first impeller 43*a* and the second impeller 43*b*. The driving shaft 14 is rotatably supported by a bearing lb fitted into the bracket 1*a*.

The first volute chamber 10*a* is communicated directly with the extension tube 4*a*, while the second volute chamber 10*b* is communicated with the extension tube 4*b* via an intermediate discharge port 17 which is formed integrally with the second volute chamber 10*b* while extending in the axial direction in the region located at the side of the first volute chamber 10*a*. With such construction, a first discharge port 18*a* and a second discharge port 18*b* are formed on the volute chamber cover 41*a* constituting a part of the pump leg 6. It is preferable that the impeller 43*a* for the first pump 40*a* arranged on the motor side is constructed in the form of a closed type impeller including a mouth ring 48 and a side plate 49 so as to suppress leakage of the liquid from the interior of the first pump 40*a* with the aid of the mouth ring 48.

According to the first embodiment of the present invention, each of the two pumps is prepared in the form of an independent pump while the pumps are fixedly mounted on the lower part of the driving shaft of a single vertical shaft type motor. With this construction, two independent pumps can rotationally be driven by the motor with a single wiring system (comprising wiring, electromagnetic contactors and others). It should be noted that the operative state of one of the two pumps is kept unchanged irrespective of whether valves on a piping system for the other pumps are fully or partially closed and that the operative state of one of the two pumps is kept substantially unchanged even though the motor is an induction motor having a rotational speed which varies slightly (due to slippage) when valves on a piping system for the other pump are manually actuated by an operator. Although the axial length of the complex pump apparatus is slightly elongated compared with a conventional single pump, the projected area of the complex pump apparatus as measured in the axial direction is substantially equal to the projected area of the motor having a capacity required for driving two pumps. In other words, the projected area assumed by the complex pump apparatus can remarkably be reduced as compared to the projected area of two conventional pumps driven by two independent motors. To sum up, since only a single motor is required for driving two independent pumps, advantageous effects obtainable from the complex pump assembly of the present invention are that: 1) the wiring system for the motor can be simplified, 2) the operative state of each pump can individually be determined and 3) the projected area of the complex pump apparatus as measured in the axial direction can be reduced substantially.

Since the bracket 1*a*, the joints 3*a* and 3*b*, the flange 7, the extension tubes 4*a* and 4*b* and the volute chamber cover 41*a* are integrated into the pump leg 6, the complex pump apparatus is simple in structure and the number of components required for constituting the complex pump assembly can be reduced substantially. Since excellently high rigidity is established among the upper first pump 40*a*, and the lower second pump 40*b* and the motor 1, each impeller can be rotated with high dimensional accuracy relative to the corresponding volute chamber. Since the two joints 3*a* and 3*b* and the two extension tubes 4*a* and 4*b* are arranged opposite each other at positions spaced apart from each other by an angle of 180 degrees in the circumferential direction, a radial load exerted on each impeller as a liquid flows along the spirally extending passage in each volute chamber is successively canceled as the impeller is rotated, resulting in a substantially decreased magnitude of radial load borne by the bearing 1*b*. In addition, the whole housing of the complex pump has high rigidity, and moreover, many components constituting the complex pump can easily be fabricated by employing a casting process. This is attributable to the fact that a plane extending through center lines of the extension tubes 4*a* and 4*b* is coincident with a parting plane X—X between the upper die half and the lower die half of a casting mold employable for casting pump leg 6, whereby the opposite ends of a core for each of the extension tubes 4*a* and 4*b* can be supported along the parting plane X—X of the casting mold.

Since the two volute chambers 10*a* and 10*b* are integrally formed in a single distance suction casing 45 by employing a sand casting process or a die casting process, the number of components required for constituting the complete pump apparatus can be reduced substantially. Since the suction ports 46*a* and 46*b* are located opposite to each other in the axial direction, and moreover, the impellers 43*a* and 43*b* are axially arranged opposite to each other in the axial direction, the thrust load appearing as the impeller 43*a* rotates is canceled by the opponent thrust load appearing as the impeller 43*b* rotates, resulting in a substantially decreased magnitude of thrust load borne by the bearing 1*b*. Since the intermediate discharge port 17 for the second pump 40*b* is integrally formed in the distance suction casing 45 without necessity for any particular piping, the distance suction casing 45 can be dimensioned to have a reduced outer diameter. Since the distance suction casing 45 can easily be assembled with the pump leg 6 and the volute chamber cover 41*b*, respectively, merely by machining two parallel surfaces thereof, a predetermined axial gap between the upper surface of each of the impellers 43*a* and 43*b* and the lower surface of an opposing member can be maintained at a high dimensional accuracy while minimizing leakage of the liquid through the foregoing gap, resulting in performances of the complex pump being improved. In addition, since the driving shaft 14 does not extend through the volute chamber cover 41*b* for the second pump 40*b*, any liquid leakage does not arise in contrast with a case where the driving shaft 14 extends therethrough. It should be noted that the advantageous effects as mentioned above are readily obtainable especially when the impeller 43*b* for the second pump 40*b* is designed in such a manner as to have a larger diameter to pump the liquid with a higher discharge pressure.

The complex pump in accordance with the first embodiment of the present invention as described above may be modified in the following manner. In practice, there is a case where it is advantageous to design the bracket 1*a* and the pump leg 6 such that they are separated from each other. In this case, an intermediate assembly is prepared using an electric motor which is not integrated with the pump leg 6. With such construction, tests can easily be conducted for the motor. In other words, a general-purpose motor can be employed for the complex pump apparatus. The flange 7, the volute chamber cover 41*a* and the extension tubes 4*a* and 4*b* may be prepared as independent members by employing a casting process in such a manner as to allow the respective cast members to be assembled together at an improved efficiency. In addition, the intermediate discharge port 17 may be constructed independently of the suction casing 45. An impeller having a high flow rate may be substituted for the lower impeller 43*b* in order to prevent suction of air in the pump due to an eddy current arising when the liquid surface level 19 is lowered for some reason. Each volute chamber should not be limited to a type having a sectional area that is gradually enlarged in the radial direction. Alternatively, the volute chamber may be designed with an outer periphery having a circular shape. Further, each pump may be designed in the form of a multistage pump.

Figure 6:
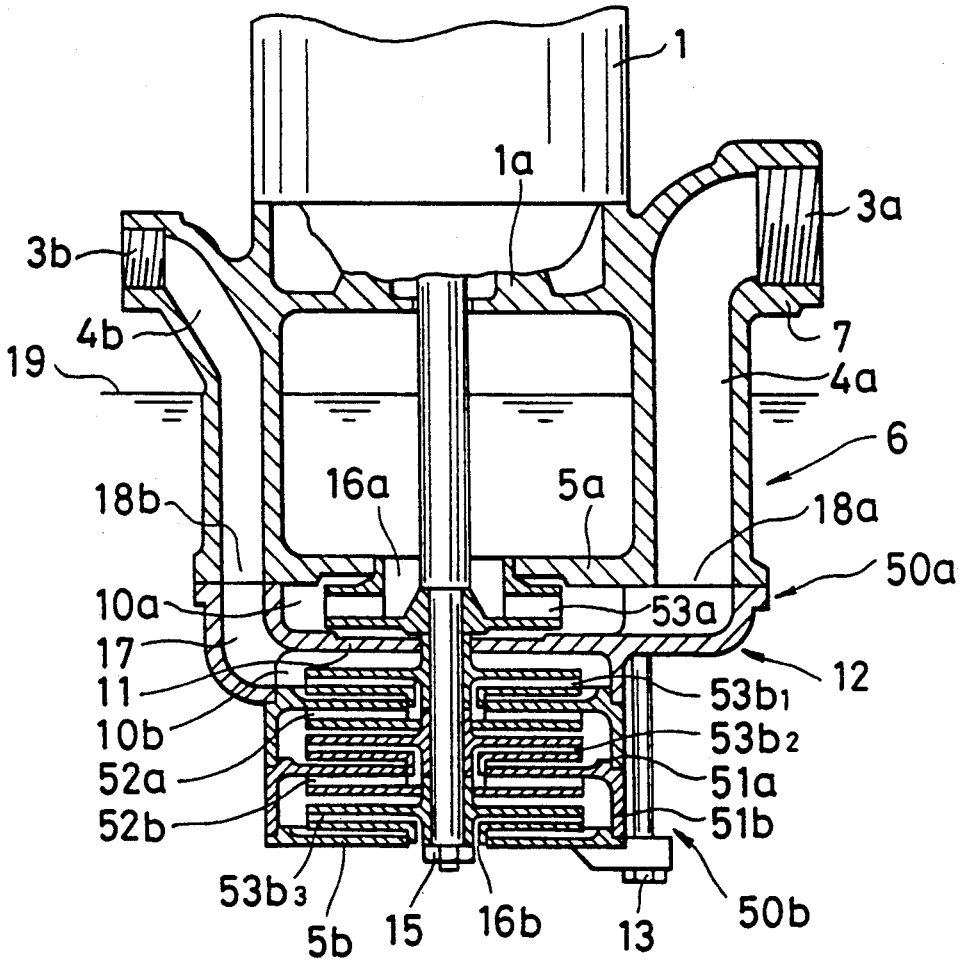
FIG. 6 is a vertical sectional view of a motor driven complex pump in accordance with a second embodiment of the present invention.

Next, a motor driven complex pump apparatus in accordance with a second embodiment of the present invention will be explained below with reference to FIG. 6. A characterizing feature of the complex pump apparatus common to the first embodiment of the present invention as mentioned above consists in that the complex pump apparatus includes joints 3*a* and 3*b* on the discharge side thereof, extension tubes 4*a* and 4*b* and a volute chamber cover 5a for a first pump 50 each of which is integrated into a pump leg 6. The two joints 3a and 3b and the two extension tubes 4a and 4b are arranged at the positions located spaced away from each other by an angle of about 180 degrees as seen in the circumferential direction. In addition, a bracket 1a and a flange 7 on the driving side of a motor 1 are integrated with pump leg 6. A suction port 16a is kept opened at the central part of the volute chamber cover 5a.

A first casing 12 is fixedly secured to the lower surface of the volute chamber cover 5a integrated with the pump leg 6. A volute chamber 10a for receiving an impeller 53a for a single stage pump 50a and a volute chamber 10b for receiving an impeller $53b_1$ at the final stage of a multistage pump 50b are formed in the first casing 12 in the back-to-back relationship with a common partition 11 interposed therebetween.

A second casing 51a and a third casing 51b are arranged below the first casing 12. The second casing 51a and the third casing 51b are fixedly secured to the pump leg 6 together with a volute chamber cover 5b by tightening a plurality of bolts 13. Guide blades 52a are secured to the second casing 51a, while guide blades 52b are secured to the third casing 51b. An impeller $53b_2$ is arranged between the guide blades 52a and the guide blades 52b, while an impeller $53b_3$ is arranged between the guide blades 52b and the volute chamber cover 5b. The volute chamber 10a of the single stage pump 50a is communicated directly with the extension tube 4a, while the volute chamber 10b of the multistage pump 50b is communicated with the extension tube 4b via an intermediate discharge port 17 which is integrally formed with the first casing 12 while extending in the axial direction in the region located sideward of the volute chamber 10a. A suction port 16b is kept opened at the central part of the volute chamber cover 5b. Both the suction ports 16a and 16b are kept opened with an axially outward oriented attitude in the region below the surface level 19 of a liquid to be pumped.

According to the second embodiment of the present invention, since a single motor is arranged for two sets of pumps, advantageous effects are that a wiring system for the motor can be simplified, the operative state of each pump can be independently determined and a projected area of the complex pump assembly in the axial direction can be substantially reduced. Since the bracket 1, the joints 3a and 3b, the flange 7, the extension tubes 4a and 4b and the volute chamber cover 5a are integrated into the pump leg 6, the complex pump apparatus is simple in structure and the number of components required for constituting the pump can be substantially reduced. Since high rigidity is established among the single stage pump 50a and the multistage pump 50b, each impeller can be rotated in the corresponding volute chamber at a high dimensional accuracy relative to the volute chamber. Since the two joints 3a and 3b and the extension tubes 4a and 4b are arranged opposite to each other at the positions spaced away from each other by an angle of about 180 degrees as seen in the circumferential direction, the radial load exerted on each impeller as a liquid flows along spirally extending passages in each volute chamber is successively canceled as the complex pump is rotated, resulting in a reduced radial load borne by a bearing 1b. In addition, the complex pump itself has excellently high rigidity, and moreover, many components constituting the complex pump can easily be fabricated by employing a casting process. This is attributable to the fact that a plane extending through the center lines of the extension tubes 4a and 4b serves as a parting plane between the upper die half and the lower die half of a casting mold, whereby the opposite ends of a core for each of the extension tubes 4a and 4b can be supported on the parting plane.

The two volute chambers 10a and 10b are integrally formed with the first casing 12 by a partition 11 interposed therebetween through use of a sand casting process or a die casting process, resulting in substantially reducing the number of components required for constituting the complex pump apparatus. Since both the suction ports 16a and 16b are kept opened with an axially opposed attitude, and moreover, the impeller 53a and the impellers $53b_1$ to $53b_3$ are arranged in the back-to-back relationship, the thrust load induced by the impeller 53a is canceled by the opponent thrust load induced by the impellers $53b_1$ to $53b_3$ a thrust load to be borne by a bearing (not shown) can be alleviated. Since the intermediate discharge port 17 for the multistage pump 50b is integrally formed easily with the first casing 12, it is not necessary to provide any particular piping and it may be possible to reduce the diametrical size of the first casing 12. A large part of the liquid leaked through an annular gap through which a driving shaft 14 of the motor 1 extends is suppressed by the hydraulic pressure of the liquid discharged from the single stage pump 50a, and the remaining liquid leaked through the same is recovered on the discharge side of the single stage pump 50a. Consequently, substantially no liquid leakage loss arises. The suction port 16a of the single stage pump 50a and the suction port 16b of the multistage pump 50b do not have a common suction space in the vicinity thereof; this is convenient when there arises a need for arranging a filter having a mesh size suitable for each pump.

Figure 7:
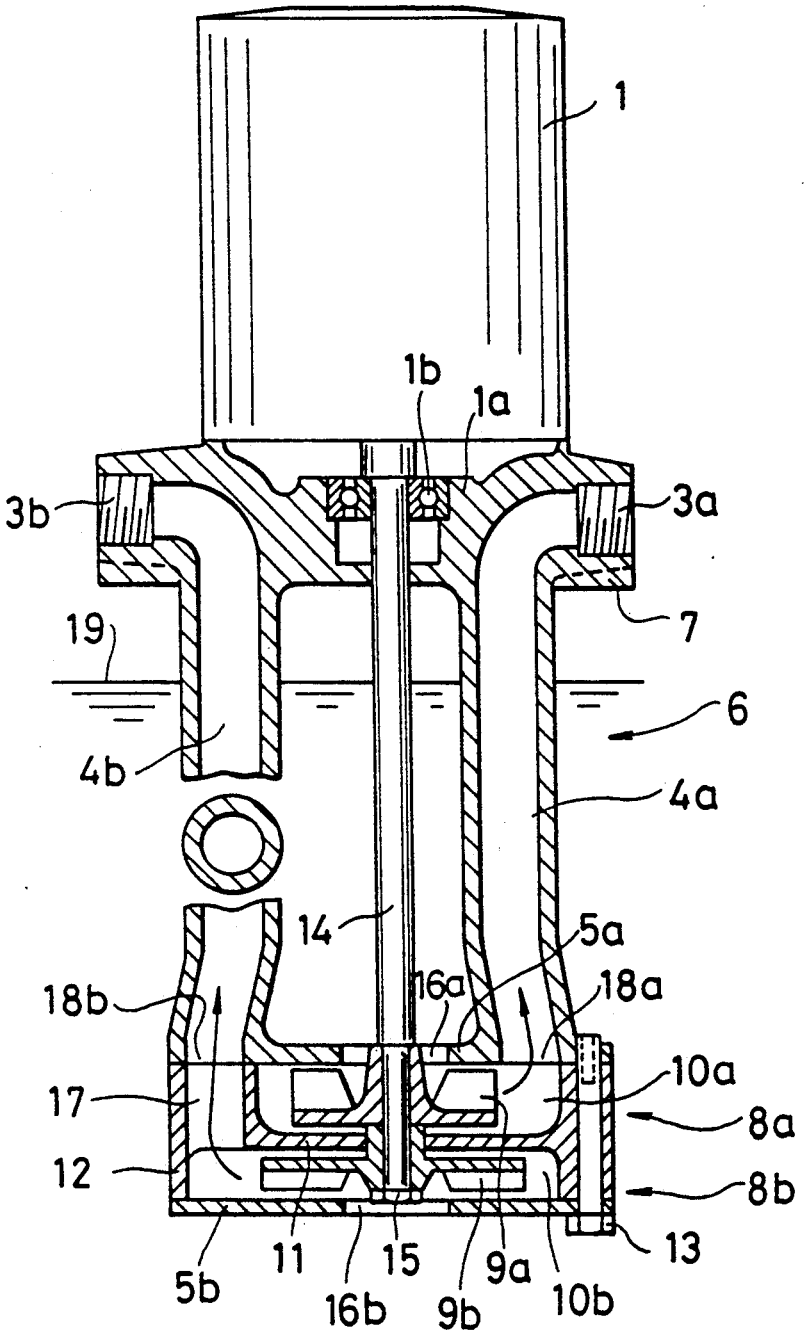
FIG. 7 is a vertical sectional view of a motor driven complex pump in accordance with a third embodiment of the present invention.

Next, a motor driven complex pump apparatus in accordance with a third embodiment of the present invention will be described below with reference to FIG. 7 that is a vertical sectional view of the complex pump assembly. As shown in the drawing, joints 3a and 3b on the discharge side of the complex pump, extension pipes 4a and 4b and a volute chamber cover 5a for a first pump 8a are integrated into a pump leg 6 on the lower driving side of a vertical shaft type motor 1. In addition, a bracket 1a and a flange 7 are integrated with the pump leg 6 on the upper driving side of the motor 1. A casing 12 is fixedly secured to the lower surface of the volute chamber cover 5a located at the lower end of the pump leg 6 by tightening a plurality of bolts 13.

A first volute chamber 10a for receiving an impeller 9a for the first pump 8a and a second volute chamber 10b for receiving an impeller 9b for a second pump 8b are formed in the casing 12 in the back-to-back relationship. Additionally, a volute chamber cover 5b for the second pump 8b is fixedly secured to the lower surface of the casing 12 together with the casing 12 at the same time when the casing 12 is fixedly secured to the volute chamber cover 5a by tightening the bolt 13 in the above-described manner. The first impeller 9a and the second impeller 9b are fixedly mounted on a driving shaft 14 by tightening a bolt 15 while the driving shaft 14 is rotatably supported by a bearing 1b 15 for the motor 1. As is apparent from the drawing, suction ports 16a and 16b are formed on the volute chamber covers 5a and 5b, while they are kept opened in the region below a surface level 19 of a liquid to be pumped.

The first volute chamber 10*a* is communicated directly with the extension tube 4*a*, while the second volute chamber 10*b* is communicated with the extension tube 4*b* via an intermediate discharge port 17 which is integrally formed with the casing 12 while extending in the axial direction in the region located at the side of the first volute chamber 10*a*. With such construction, a first discharge port 18*a* and a second discharge port 18*b* are formed on the first volute chamber cover 5*a* that is a part of the pump leg 6.

Advantageous effects obtainable according to the third embodiment of the present invention are that a wiring system for the motor can be simplified, the operative state of each pump can be determined independently and a projected area of the complex pump in the axial direction can be reduced. Since the bracket 1*a*, the joints 3*a* and 3*b*, the flange 7, the extension tubes 4*a* and 4*b* and the first volute chamber cover 5*a* are integrated into the pump leg 6, the complex pump apparatus is simple in structure. Since excellently high rigidity is established among the upper first pump 8*a*, the lower second pump 8*b* and the motor 1, each impeller can be rotated in the corresponding volute chamber with high accuracy relative to the fixed dimensions of the volute chamber. The two volute chambers are formed without any undercut from the opposite sides thereof, and moreover, they are integrally formed with the casing 12 by employing a sand casting process or a die casting process. Also, the volute chamber 10*a* of the first pump 8*a* is smaller than each of the first and second the volute chambers 10*b* of the second pump 8*b*, the intermediate discharge port 17 for the second pump 8*b* can easily be integrally formed with the casing 12 without the need for a special piping system. To assure that the second impeller 9*b* can freely be rotated together with the driving shaft 14, an annular gap is formed between the partition 11 and the second impeller 9*b*. However, some leakage loss unavoidably arises due to a difference between the discharge pressure from the first pump 8*a* and the discharge pressure from the second pump 8*b*. However, this leakage loss is very small compared with leakage loss induced by the discharge pressure from a volute chamber through an annular gap between a volute chamber and a driving shaft for a conventional pump. It should be noted that there does not arise any leakage loss when both the first and second pumps 8*a* and 8*b* generate a same discharge pressure. The casing 12 can be fixedly secured to the pump leg 6 and to the volute chamber cover 5*b* merely by maintaining two parallel surfaces of the casing 12.

The third embodiment of the present invention may be modified in the following manner. In practice, there is a case where it is advantageous to separate the bracket 1*a* from the pump leg 6. In this case, an intermediate assembly is prepared by using a motor having no pump leg. With such construction, tests can be easily conducted for the motor without interference from the pump leg. Thus, a general-purposed motor can be employed for the complex pump. The flange may be connected to the volute chamber cover by using a plate-shaped connecting member. In the case where each extension tube is arranged independently from the pump leg by connecting the flange 7 and the volute chamber cover 5*a* with a plate-like connector, it can be easily fabricated by employing a casing process. In addition, the intermediate discharge port may be formed independently from the casing 12. An impeller having a higher flow rate may be substituted for the impeller 9*b* for the second pump 8*b* so as to prevent suction of an air due to an eddy current of the liquid induced at the time when the liquid surface level 19 is lowered. Each volute chamber should not be limited to such a type having a sectional area which gradually increases in the radial direction but the volute chamber may be prepared having a simple circular shape. In addition, each pump may be a multistage pump.

Figure 8:
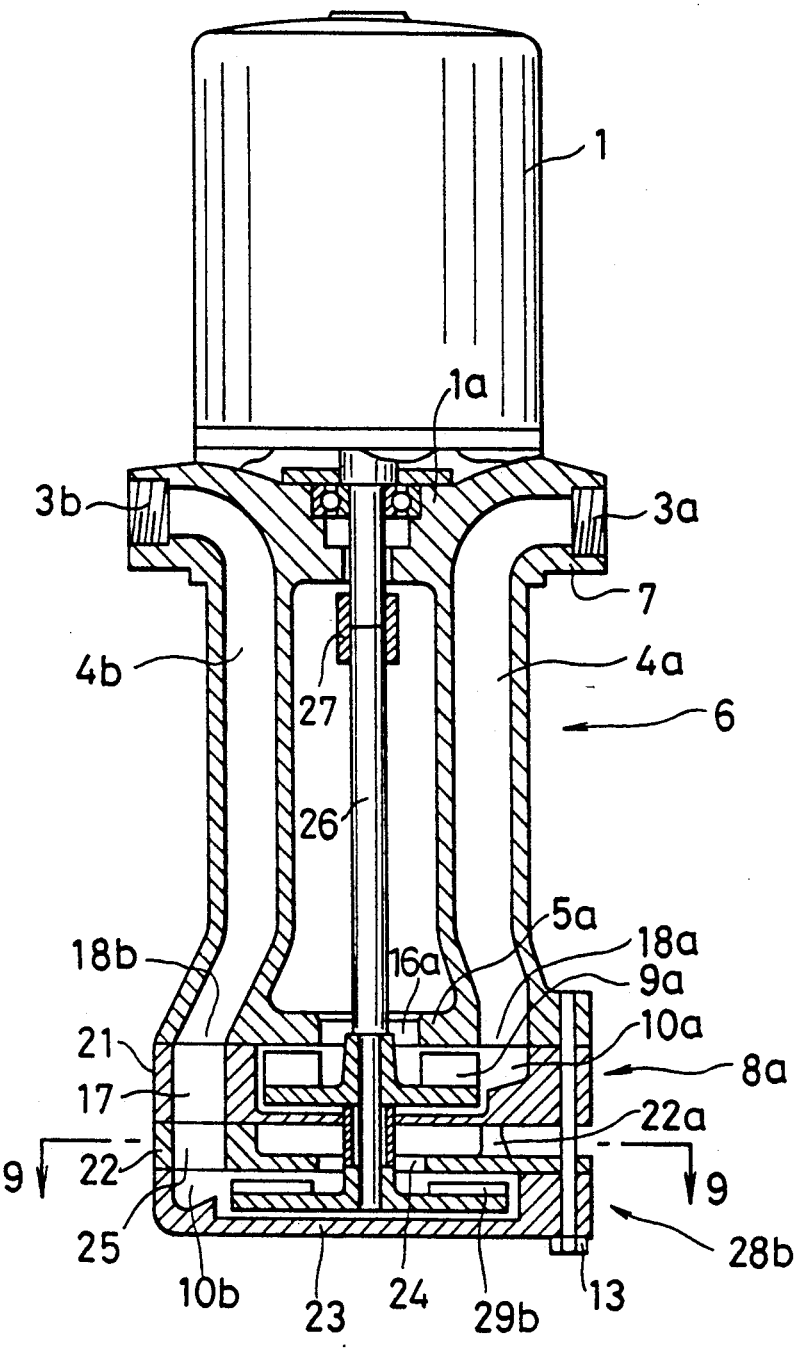
FIG. 8 is a vertical sectional view of a motor driven complex pump in accordance with a fourth embodiment of the present invention.
Figure 9:
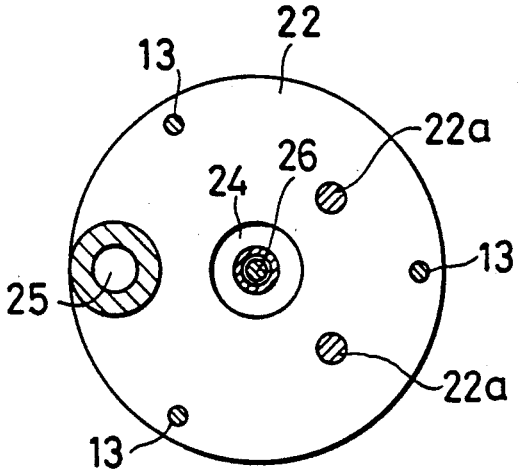
FIG. 9 is a cross-sectional view of the complex pump taken along line III—III in FIG. 8.

A motor driven complex pump apparatus in accordance with a fourth embodiment of the present invention will be described below with reference to FIG. 8 and FIG. 9. A pump leg 6 is secured to a motor 1, and joints 3*a* and 3*b* on the discharge side of the complex pump, extension tubes 4*a* and 4*b*, a volute chamber cover 5*a*, and also a bracket 1*a* and flange 7 are integrally formed into the pump leg 6. The pump leg 6 in this embodiment is the same as the pump leg of the third embodiment of the present invention. A first casing 21, a distance casing 22 and a second casing 23 are successively fixedly secured in parallel alignment with each other onto the lower surface of the volute chamber cover 5*a* of the pump leg 6 by tightening a plurality of bolts 13. A volute chamber 10*a* for a first pump 8*a* is formed in the first casing 21 so as to receive an impeller 9*a* therein. In addition, an intermediate discharge port 17 is integrally formed with the first casing 21 in the region located at the side of the volute chamber 10*a*. A suction port 24 for a second pump 28*b* and a communication discharge port 25 for the second pump 28*b* are formed on the spacer casing 22. In addition, support columns 22*a* are integrally formed with the distance casing 22 so as to assure rigidity for maintaining a predetermined distance between the first casing 21 and the second casing 23. No suction port is formed in the second casing 23 itself but a volute chamber 10*b* is formed in the same. The volute chamber 10*b* is communicated with the joint 3*b* via the second communication discharge port 25, the first intermediate discharge port 17 and the extension tube 4*b*. According to the fourth embodiment of the present invention, a driving shaft 26 is separated from an output shaft of the motor 1 but the former is operatively connected to the latter via a coupling 27.

A characterizing feature of the complex pump apparatus in accordance with the fourth embodiment of the present invention consists in that liquid leakage does not arise at all, since the driving shaft 26 does not extend through a wall on the pressure chamber side (i.e., volute chamber side) of the second pump 28*b* having a higher discharge pressure. It should be noted that a pump having a lower flow rate may be arranged on the upper side so as to prevent air suction from occurring due to an eddy current of the liquid induced from the surface level side. Advantageous effects obtainable from the fourth embodiment of the present invention are that 1) a wiring system for the motor can be simplified, 2) the operative state of each pump can be independently determined, 3) a projected area of the complex pump assembly as measured in the axial direction can be reduced and 4) rigidity of the complex pump can be substantially improved by integrating essential components into the pump leg. Another advantageous effect of the present invention is that two discharge pipings for the complex pump, i.e., the intermediate discharge port 17 and the communication discharge port 25 can be formed automatically by successively placing the first casing 21, the distance casing 22 and the second casing 23 one above another.

Figure 10:
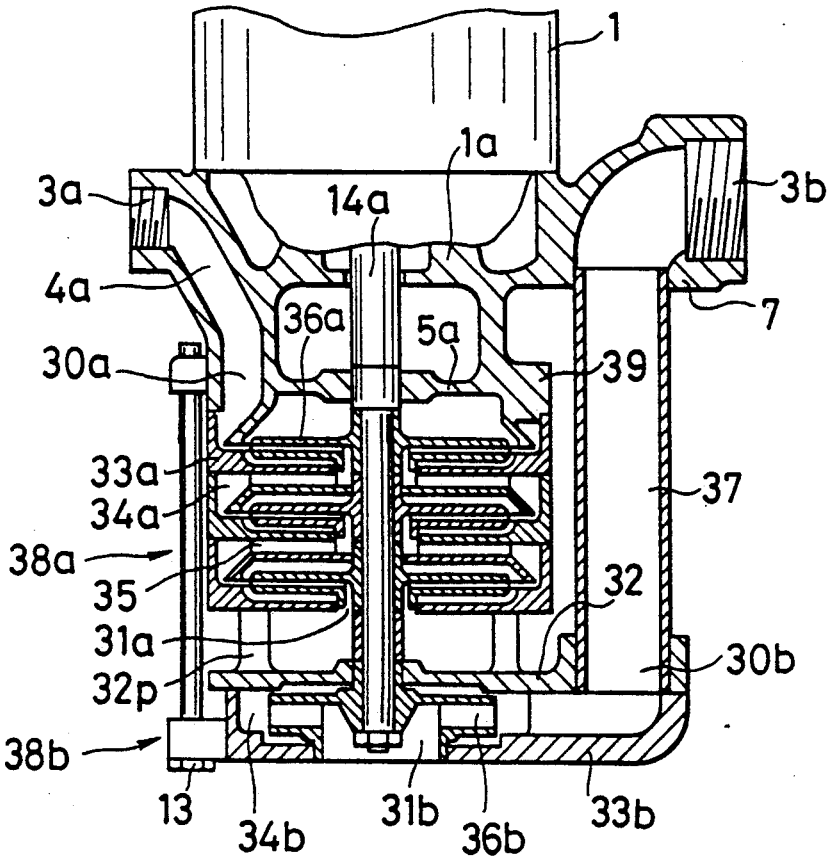
FIG. 10 is a vertical sectional view of a motor driven complex pump in accordance with a fifth embodiment of the present invention.

Next, a motor driven complex pump apparatus in accordance with a fifth embodiment of the present invention will be described below with reference to FIG. 10. A pump leg 39 is secured to a motor 1, and joints 3*a* and 3*b* on the discharge side of the complex pump, an extension tube 4*a*, a bracket 1*a* and a flange 7 are integrated into the pump leg 39. An extension tube 37 is not integrated onto the pump leg 39 but is threadably engaged with the joint 3*b*. A multistage pump 38*a* comprising a plurality of impellers 36*a* and a plurality of casings 33*a* is arranged as a first pump at the lower end part of the pump leg 39. Each casing 33*a* includes an annular volute chamber 34*a* and guide blades 35. A suction port 31*a* at the first stage is opened with a downward oriented attitude, and a volute chamber at the final stage is communicated with the lower end of the extension tube 4*a* integrally formed with the pump leg 39.

A distance casing 32 including support columns 32*p* and a part of a casing for a second pump 38*b* with a discharge port 30*b* formed thereon is fixedly secured to the lower end of the casing 33*a* having the suction port 31*a* at the first stage formed thereon. In addition, a casing 33*b* for the second pump 38*b* having an impeller 36*b* received therein with a downward oriented suction port 31*b* and including a volute chamber 34*b* is secured to the lower end of the distance casing 32. The discharge port 30*b* is connected to the extension tube 37, and the first pump 38*a* and the second pump 38*b* are fixedly secured to the pump leg 39 by tightening a plurality of bolts 13.

The fifth embodiment of the present invention may be modified in the following manner. For example, the suction port of the first pump 38*a* may be oriented toward the motor side. In addition, the extension tube 37 usually made of a gas tube or the like may be eliminated. In this case, an extension tube integrated with the pump leg 39 while extending from the joint 3*b* to the position identified by reference character B serves as a discharge port. Further, a intermediate discharge port through which the volute chamber 34*b* of the second pump 38*b* communicates with the discharge port of the tube 37, which is integrated with the pump leg 39, may be integrally formed not only with the side part of each casing 33*a* of the multistage pump 38*a* but also with the side part of the distance casing 32.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A motor driven complex pump apparatus comprising:

an electric motor for driving a driving shaft, said driving shaft extending in a substantially vertical direction;

a pump leg member having upper and lower sides, the upper side of said pump leg member supporting said motor and the lower side thereof defining a first part of a volute chamber of a first pump, said driving shaft extending through the pump leg member;

first casing means arranged below said pump leg member, said first casing means defining a second part of the volute chamber of said first pump;

second casing means arranged below said first casing means, said second casing means defining a volute chamber of a second pump, said first casing means and an upper side of said second casing means constituting a distance suction casing, said distance suction casing comprising a first horizontal wall having a suction port for said first pump formed therein;

a second horizontal wall having a suction port for said second pump formed therein, said second horizontal wall extending substantially in parallel with and being a predetermined distance apart from said first horizontal wall; and an intermediate discharge port communicated with a discharge port of said second pump, said intermediate discharge port extending in the substantially vertical direction in the region located at the side of said first horizontal wall and said second horizontal wall; and first and second impellers fixedly mounted on said driving shaft, said first impeller being received in said first casing means and said second impeller being received in said second casing means.

2. The apparatus as claimed in claim 1, wherein said pump leg member integrally comprises:

a flange for mounting the apparatus;

a first extension tube portion communicated with said first pump;

a second extension tube portion communicated with said second pump;

a first discharge joint communicated with said first extension tube portion; and a second discharge joint communicated with said second extension tube portion.

3. The apparatus as claimed in claim 2, wherein said first extension tube portion and said second extension tube portion are arranged opposite to each other at the positions spaced away from each other by an angle of about 180 degrees.

4. The apparatus as claimed in claim 1, wherein said second impeller is dimensioned to have a diameter larger than that of said first impeller.

5. The apparatus as claimed in claim 1, wherein said second impeller is dimensioned to have a diameter larger than that of said first impeller.

6. The apparatus as claimed in claim 1 further comprising support columns between said first horizontal wall and said second horizontal wall.

7. A motor driven complex pump apparatus comprising:

an electric motor for driving a driving shaft, said driving shaft extending in a substantially vertical direction;

a pump leg member having upper and lower sides, the upper side of said pump leg member supporting said motor and the lower side thereof defining a first part of a volute chamber of a first pump, said driving shaft extending through the pump leg member;

first casing means arranged below said pump leg member, said first casing means defining a second part of the volute chamber of said first pump;

second casing means arranged below said first casing means, said second casing means defining a volute chamber of a second pump, the first casing means and an upper side of the second casing means constituting a common casing, said common casing comprising:

a horizontal partition disposed between said first pump and said second pump, said horizontal partition preventing fluid communication between said first and said second pumps; and an intermediate discharge port communicated with a discharge port of said second pump, said intermediate discharge port extending in the substantially vertical direction in the region located radially outward of both said horizontal partition and said volute chamber of said first pump; and first and second impellers fixedly mounted on said driving shaft, said first impeller being received in said first casing means and said second impeller being received in said second casing means.

8. The apparatus as claimed in claim 7, wherein a suction port of said first pump is formed around a through hole opened on said pump leg member so as to allow said driving shaft to extend through said through hole, and a suction port of a second pump is formed at the central part of a cover member placed on the lower end of said common casing.

9. The apparatus as claimed in claim 7, wherein a plurality of pump casings are additionally arranged below said common casing, and said second pump is a multistage pump.

10. The apparatus as claimed in claim 7, wherein said first casing means and said second casing means are fixedly secured to said pump leg member by tightening a plurality of bolts.

11. A motor driven complex pump apparatus comprising:

an electric motor for driving a driving shaft, said driving shaft extending in a substantially vertical direction;

a pump leg member having upper and lower sides, the upper side of said pump leg member supporting said motor and the lower side thereof defining a first part of a volute chamber of a first pump, said driving shaft extending through the pump leg member;

first casing means arranged below said pump leg member, for defining a second part of the volute chamber of said first pump, said first casing means comprising an intermediate discharge port extending in the substantially vertical direction in a region located at the side of said volute chamber of said first pump;

second casing means arranged below said first casing means, for defining a volute chamber of a second pump, said second casing means comprising a first casing member defining an upper side of said volute chamber of said second pump and having a suction port formed at the central part thereof, and a spacer casing member having a communication discharge port formed at the side thereof which communicates with said first intermediate discharge port; and a second casing member secured to said first casing member by means of said spacer casing and having a discharge port formed therein, said discharge port being communicated with said communication discharge port; and first and second impellers fixedly mounted on said driving shaft, said first impeller being received in said first casing means and said second impeller being received in said second casing means.

12. The apparatus as claimed in claim 11, wherein said second impeller is dimensioned to have a diameter larger than that of said first impeller.

* * * * *